US005734123A

United States Patent [19]

Wheatley et al.

[11] Patent Number: 5,734,123

[45] Date of Patent: Mar. 31, 1998

[54] EXTRUDABLE GAS-GENERATING COMPOSITIONS

[75] Inventors: Brian K. Wheatley, Marshall; James D. Martin, Manassas, both of Va.

[73] Assignee: Atlantic Research Corporation, Gainesville, Va.

[21] Appl. No.: 538,325

[22] Filed: Oct. 3, 1995

[51] Int. Cl.[6] ..... C06B 45/10

[52] U.S. Cl. ..... 149/19.7; 280/741

[58] Field of Search ..... 149/19.7; 280/741

[56] References Cited

U.S. PATENT DOCUMENTS

| | | | |
|---|---|---|---|
| 2,973,255 | 2/1961 | Eiszner et al. | 149/19.7 |
| 3,020,180 | 2/1962 | Morello | 149/19.7 |
| 3,126,304 | 3/1964 | Penner et al. | 149/19.7 |
| 3,132,058 | 5/1964 | Morello | 149/19.7 |
| 3,148,096 | 9/1964 | Butcher | 149/19.7 |
| 3,161,550 | 12/1964 | Mosher et al. | 149/19.7 |
| 3,180,772 | 4/1965 | O'Conner et al. | 149/19.7 |
| 3,214,305 | 10/1965 | Bowman et al. | 149/19.7 |
| 3,293,090 | 12/1966 | Henderson | 149/19.7 |
| 3,964,256 | 6/1976 | Plantif et al. | 60/219 |
| 3,986,908 | 10/1976 | Grébert et al. | 149/19.7 |
| 4,570,540 | 2/1986 | Bell | 149/19.7 |
| 5,125,684 | 6/1992 | Cartwright | 149/19.7 |
| 5,482,579 | 1/1996 | Ochi et al. | 149/83 |

OTHER PUBLICATIONS

Hawley (ed.), *The Condensed Chemical Dictionary*, 9th Ed., p. 691, Von Nosrand Reinhold Co. (1977) New York.

*Primary Examiner*—Edward A. Miller

*Attorney, Agent, or Firm*—Lowe, Price, LeBlanc & Becker

[57] ABSTRACT

A gas-generating composition for inflating inflation devices such as air bags, life rafts, slide chutes, and the like which comprises an oxidizer component, cellulose acetate and plasticizer. The cellulose acetate and plasticizer provides a binder system which does not produce hazardous compounds upon combustion. Molded articles can be formed by injection molding or extruding the composition.

10 Claims, No Drawings

EXTRUDABLE GAS-GENERATING COMPOSITIONS

TECHNICAL FIELD

The present invention relates to inflators for devices such as protective passive restraints or "air bags" used in motor vehicles, escape slide chutes, life rafts, and the like. More particularly, the present invention relates to gas-generating compositions which are used in inflators.

BACKGROUND ART

Many devices, such as protective passive restraints or "air bags" used in motor vehicles, escape slide chutes, life rafts, and the like, are normally stored in a deflated state and are inflated with gas at the time of need. Such devices are generally stored and used in close proximity to humans and, therefore must be designed with a high safety factor which is effective at all times.

Inflation is generally accomplished by means of a gas, such as air, nitrogen, carbon dioxide, helium, and the like which is stored under pressure and further pressurized and supplemented at the time of use by the addition of high temperature combustion gas products produced by the burning of a gas-generating composition. In some cases, the inflation gases are solely produced by gas-generating compositions.

The components of gas-generating compositions are incorporated into mechanical inflator devices in the form of powders, grains, pellets, or the like. A particular convenient manner to incorporate gas-generating compositions into inflator devices is to form or mold the compositions into solid structures.

One concern with molded gas-generating components is that in order to be moldable they generally include binder components, some of which are suspected of producing hazardous combustion products. For example, polyvinyl chloride (PVC) is suspected of producing dioxins when it is combusted at elevated temperatures.

The present invention is directed to moldable gas-generating compositions which do not include binder components which are suspected of producing harmful combustion products. More particularly, the present invention is directed to moldable gas-generating compositions which avoid the use of polyvinyl chloride (PVC) binders.

DISCLOSURE OF THE INVENTION

It is accordingly an object of the present invention to provide gas-generating compositions which can be molded into solid structures.

Another object of the present invention is to provide gas-generating compositions which can be injection molded or extruded.

It is another object of the present invention to provide moldable gas-generating compositions which do not include binder components which produce harmful combustion products.

A further object of the present invention is to provide moldable gas-generating compositions which do not include polyvinyl chloride binder components.

A still further object of the present invention is to provide moldable gas-generating compositions which include cellulose acetate and a plasticizer as a binder system.

A yet further object of the present invention is to provide a method of molding gas-generating compositions.

A yet further object of the present invention is to provide a method of molding gas-generating compositions which include cellulose acetate and a plasticizer as a binder system.

According to these and further objects of the present invention which will become apparent as the description thereof proceeds, the present invention provides a moldable gas-generating composition which includes:

an oxidizer component;

cellulose acetate; and a plasticizer selected from the group consisting of acetyl triethyl citrate, ethyl phthalylethyl glycolate, diethyl phthalate, and mixtures thereof.

The present invention further provides a method of forming a molded gas-generating composition which involves:

forming a moldable gas-generating composition which includes an oxidizer component, cellulose acetate, and a plasticizer selected from the group consisting of acetyl triethyl citrate, ethyl phthalylethyl glycolate diethyl phthalate, and mixtures thereof;

shaping the moldable gas-generating composition; and curing the shaped gas-generating composition.

BEST MODE FOR CARRYING OUT THE INVENTION

The present invention is directed to gas-generating compositions which, upon ignition, rapidly generate large amounts of gaseous reaction products. The gas-generating compositions of the present invention are moldable. In this regard, they can be prepared so as to have a suitable viscosity for injection molding, extrusion, or the like. After molding the composition can be cured to form solid structures.

In use, the gas-generating compositions are molded into solid shapes which are incorporated into mechanical inflator devices such as protective passive restraints or "air bags" used in motor vehicles, escape slide chutes, life rafts, or the like. The present gas-generating compositions are preferably used in conjunction with inflator devices which primarily rely upon stored pressurized gas, and combustible gas-generating compositions to supplement the pressure of the stored gas at the time of use. Such systems are exemplified in U.S. Pat. Nos. 3,723,205 and 4,981,534 to Scheffee. Alternatively, the present gas-generating compositions can be used as the primary source of gas used to inflate an inflation device.

When incorporated into mechanical inflator devices, the gas-generating compositions of the present invention can be ignited by a conventional initiator or ignitor. For example, when used in conjunction with protective passive restraints or "air bags" used in motor vehicles, electric squibs which are activated upon a sensed impact of the motor vehicle can be used to ignite the gas-generating compositions.

The gas-generating compositions of the present invention include an oxidizer component, a binder component which serves as a fuel, and a plasticizer for the binder component which also serves as a fuel.

Suitable oxidizers which can be used in the gas-generating compositions include alkali metal chlorates, alkali metal perchlorates, and mixtures thereof. Examples of these oxidizers include sodium chlorate, potassium chlorate, lithium chlorate, sodium perchlorate, potassium perchlorate, and lithium perchlorate. Other oxidizers which can be use include alkaline earth metal perchlorates and ammonium perchlorate.

One oxidizer which has been found to be particularly useful for purposes of the present invention is potassium perchlorate.

The preferred binder component used in the gas-generating compositions is cellulose acetate. This binder functions as both a binder and a fuel component in the composition. Cellulose acetate has been found to be a desirable binder component since it does not produce hazardous compounds upon combustion. The cellulose acetate must be plastisol grade, i.e., in the form of fused, spherical particles of the proper particle size distribution.

In order to make the composition moldable and curable, a plasticizer is included, which also functions as a fuel component. It is important to select a plasticizer which satisfies processing requirements and is thermally stable. When the gas-generating composition is to be used in conjunction with air bags, it is important that a plasticizer is selected which allows the composition to meet the physical requirements of air bag propellants. For example, air bag propellants must be able to withstand vibration which occurs in motor vehicles.

Suitable plasticizers for the gas-generating compositions of the present invention include acetyl triethyl citrate (Citroflex®), ethyl phthalylethyl glycolate, and diethyl phthalate.

In preferred embodiments the oxidizer component comprises about 70 to 80 weight percent of the gas-generating compositions, the binder component comprises about 5 to 15 weight percent of the composition, and the plasticizer comprises about 10 to 25 weight percent of the composition.

In more preferred embodiments the oxidizer component comprises about 75 to 80 weight percent of the gas-generating compositions, the binder component comprises about 6 to 10 weight percent of the composition, and the plasticizer comprises about 12 to 20 weight percent of the composition.

In even more preferred embodiments the oxidizer component comprises about 75 weight percent of the gas-generating compositions, the binder component comprises about 8 to 9 weight percent of the composition, and the plasticizer comprises about 16 to 18 weight percent of the composition.

The gas-generating compositions of the present invention are prepared by mixing the individual components together. In preparing the composition, the binder component and oxidizer component can be premixed together. It is preferred to add the plasticizer to the binder component and oxidizer component just prior to molding or extruding the composition so that the composition does not begin to cure prematurely.

The components can be mixed together utilizing conventional mixers, blenders, mills, etc. which are known to be useful for mixing pyrotechnic compositions.

During a typical extrusion process, an extrudable mass of the composition is prepared by mixing the components together. The extrudable mass is then fed into an extruder, extruded and blocked as desired. Next the extrudable mass is extruded, cut free and cured.

The viscosity of the mixed composition can be adjusted as necessary by incorporating a removable solvent such as ethyl acetate, acetone, ethyl alcohol, or mixtures thereof. The necessary viscosity for extrusion (or injection molding) can easily be determined based upon the specifications of the processing equipment used.

In addition to the above-discussed components, the gas-generating compositions of the present invention may include up to 1.0 weight percent of other components such as conventional stabilizers, colorants, opacifiers, and the like as desired.

In a preferred embodiment of the gas-generating compositions the compositions included up to about 0.1 weight percent of carbon black and up to about 0.4 weight percent of magnesium hydroxide or calcium stearate as a stabilizer or a blend of magnesium hydroxide and calcium stearate (e.g., 50:50).

Features and characteristics of the present invention will be further understood from the following non-limiting examples which are included for exemplary purposes. In these examples and throughout the specification, percentages are given as weight percents unless otherwise indicated.

EXAMPLE 1

In this example a gas-generating composition having the following formulation was prepared:

TABLE 1

| Component | Parts by Weight |
|---|---|
| Cellulose Acetate | 8.233 |
| Acetyl Triethyl Citrate[1] | 16.467 |
| Potassium Perchlorate | 75.000 |
| Carbon Black | 0.050 |
| Calcium Stearate | 0.125 |
| Magnesium Hydroxide[2] | 0.125 |

[1]Citroflex ® A-2
[2]Stabilizer System

The above formulation was mixed, molded, cured and found to have the following properties.

TABLE 2

| Property | Type | Value |
|---|---|---|
| Theoretical | 1. density, lb/in$^3$ | 0.07096 |
| | 2. flame temperature, °F. | 2883 |
| Rheology | 1. mix viscosity, kP | 7 |
| | 2. pot-life, hrs to 50 kP | >24 |
| 70° F. | 1. stress, psi | 464 |
| Tensile | 2. strain (max/rupture), % | 4.6/5.8 |
| | 3. modulus, psi | 26.9K |
| Burning | 1. rate @ 1000 psi, ips | 0.46 |
| Rate | 2. pressure exponent | 0.80 |
| Ballistics | 1. grain length, mm | 21.6/24.6 |
| (61 mm/74 mm | 2. hold dia., mm | 7.11/10.01 |
| design) | 3. web, mm | 2.03/1.14 |
| | 4. propellant mass, gm | 38.75/32.0 |
| Hazards | 1. impact, kg-cm | 85 |
| | 2. friction, psi/drop angle | >1800/90° |
| | 3. static, J @ 5000 volts | >6.0 |
| | 4. thermal | |
| | DSC (initial exo.), °C. | 300 |
| | Activation energy, kcal/mole | 29 |
| | pre-exponential factor, min−1 | 9.1 |
| | oven stability (400° F./64 hrs) | neg. |
| | 5. card gap, # cards | neg./0 cards |
| Aging | 1. 300° F/64 hrs | |
| | Shore A before/after | 91/95 |
| | 2. 225° F/17 days | |
| | stress before/after | 464/491 |
| | strain before/after | 4.6/2.8 |
| | modulus before/after | 26.9K/40.9K |
| | burning rate, ips @ 1000 psi | 0.46/0.51 |
| | 3. plasticizer loss, % plasticizer | 1.8 |

This data indicates that the formulation meets the requirements for air bag generator (inflator) applications.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as described by the claims which follow.

We claim:

1. A moldable gas-generating composition consistinq essentially of:

a) about 70 to about 80 weight percent based upon the moldable gas-generating composition of an oxidizer component selected from the group consisting of alkali metal chlorates, alkali metal perchlorates, alkaline earth metal chlorates, alkaline earth metal perchlorates, ammonium perchlorate and mixtures thereof;

b) about 5 to about 15 weight percent based upon said moldable gas-generating composition of a binder which is cellulose acetate; and c) about 10 to about 25 weight percent of said composition of a plasticizer selected from the group consisting of acetyl triethyl citrate, ethyl phthalylethyl glycolate, and mixtures thereof.

2. A moldable gas-generating composition according to claim 1, wherein the amount of said binder component is about 6 to 10 weight percent of said composition, and the amount of said plasticizer is about 12 to 20 weight percent of said composition.

3. A moldable gas-generating composition according to claim 2, wherein the amount of said oxidizer component is about 75 weight percent of said gas-generating composition, the amount of said binder component is about 6 to 10 weight percent of said composition, and the amount of said plasticizer is about 16 to 18 weight percent of said composition.

4. A moldable gas-generating composition according to claim 1, further consisting essentially of carbon black and a stabilizer.

5. A moldable gas-generating composition according to claim 4, wherein the amount of said oxidizer component is about 75 to 80 weight percent of said gas-generating composition, the amount of said binder component is about 6 to 10 weight percent of said composition, the amount of said plasticizer is about 12 to 20 weight percent of said composition, the amount of said carbon black is about 0.01 to 0.05 weight percent of said composition, and the amount of said stabilizer is about 0.05 to 1.0 weight percent of said composition.

6. A moldable gas-generating composition according to claim 5, wherein the amount of said oxidizer component is about 75 weight percent of said gas-generating composition, the amount of said binder component is about 8 to 9 weight percent of said composition, the amount of said plasticizer is about 16 to 18 weight percent of said composition, the amount of said carbon black is about 0.05 weight percent of said composition, and the amount of said stabilizer is about 0.25 weight percent of said composition.

7. A moldable gas-generating composition according to claim 1, which further consists essentially of a removable solvent.

8. In an inflater for inflating emergency devices which inflater includes a gas-generating composition, the improvement wherein said gas-generating composition is moldable and consists essentially of a) about 70 to about 80 weight percent based upon said gas-generating composition of an oxidizer component selected from the group consisting of alkali metal chlorates, alkali metal perchlorates, alkaline earth metal chlorates, alkaline earth metal perchlorates, ammonium perchlorate and mixtures thereof;

b) about 5 to about 15 weight percent based upon said gas-generating composition of a binder which is cellulose acetate, and c) about 10 to about 25 weight percent based upon said gas-generating composition of a plasticizer selected from the group consisting of acetyl triethyl citrate, ethyl phthalylethyl glycolate, and mixtures thereof; together with carbon black and a stabilizer.

9. The inflater according to claim 8 wherein the oxidizer is an alkali metal perchlorate and/or ammonium perchlorate and the plasticizer is ethyl phthalylethyl glycolate.

10. The moldable gas-generating composition according to claim 1 wherein the oxidizer is an alkali metal perchlorate and/or ammonium perchlorate and the plasticizer is ethyl phthalylethyl glycolate.

* * * * *